US008671595B2

(12) United States Patent
Nelson

(10) Patent No.: US 8,671,595 B2
(45) Date of Patent: Mar. 18, 2014

(54) ORNAMENTATION FOR A FOOTWEAR UPPER

(76) Inventor: Paula Catherine Nelson, East Fremantle (AU)

( * ) Notice: Subject to any disclaimer, the term of this patent is extended or adjusted under 35 U.S.C. 154(b) by 26 days.

(21) Appl. No.: 13/070,887

(22) Filed: Mar. 24, 2011

(65) Prior Publication Data

US 2011/0225851 A1 Sep. 22, 2011

Related U.S. Application Data

(63) Continuation of application No. PCT/AU2009/001265, filed on Sep. 24, 2009.

(30) Foreign Application Priority Data

Sep. 24, 2008 (AU) ..... 2008904977

(51) Int. Cl.
*A43B 23/00* (2006.01)
*A43B 23/24* (2006.01)

(52) U.S. Cl.
USPC ..... 36/136; 2/244; 24/105

(58) Field of Classification Search
USPC ..... 36/136, 11.5; 2/245, 244; 24/105
See application file for complete search history.

(56) References Cited

U.S. PATENT DOCUMENTS

| | | | | |
|---|---|---|---|---|
| 1,738,605 | A * | 12/1929 | Myers et al. | 2/245 |
| 5,195,220 | A | 3/1993 | Herman | |
| 5,857,220 | A * | 1/1999 | Erny et al. | 2/244 |
| 7,328,528 | B2 * | 2/2008 | Caminiti | 36/136 |
| 7,698,836 | B2 * | 4/2010 | Schmelzer et al. | 36/136 |
| 8,266,769 | B2 * | 9/2012 | Murray et al. | 24/3.12 |
| 2007/0084019 | A1 | 4/2007 | Wilcox et al. | |
| 2008/0060110 | A1 * | 3/2008 | Schmelzer et al. | 2/69 |
| 2008/0289076 | A1 * | 11/2008 | Millward | 2/69 |
| 2009/0300948 | A1 * | 12/2009 | Nordstrom-Wehner | 36/136 |
| 2010/0011623 | A1 * | 1/2010 | Seckler et al. | 36/136 |
| 2010/0047604 | A1 * | 2/2010 | Stratton-Metzger | 428/542.2 |
| 2010/0058619 | A1 * | 3/2010 | Ferrante et al. | 36/136 |
| 2010/0162591 | A1 * | 7/2010 | Schmelzer et al. | 36/136 |
| 2011/0041363 | A1 * | 2/2011 | Stanfield et al. | 36/136 |
| 2012/0222331 | A1 * | 9/2012 | Blunden et al. | 36/102 |
| 2012/0234042 | A1 * | 9/2012 | Chase et al. | 63/1.18 |

FOREIGN PATENT DOCUMENTS

EP 0976338 2/2000

OTHER PUBLICATIONS

International Search Report, PCT/AU2009/001265, mailed Oct. 26, 2009.
Written Opinion of the International Searching Authority, PCT/AU2009/001265, mailed Oct. 26, 2009.
International Preliminary Report on Patentability, PCT1AU2009/001265, mailed Oct. 26, 2009.
Examination Report mailed Oct. 23, 2013 for Application No. AU 2009295344.

* cited by examiner

*Primary Examiner* — Marie Patterson
(74) *Attorney, Agent, or Firm* — Mollie E. Lettang; Daffer McDaniel LLP

(57) ABSTRACT

An ornamentation attachable to a strap, such as a strap of on an item of a footwear. The ornamentation comprises a base, an ornament associated with the base and a mounting means for mounting the base to the strap. The ornament may be associated with the base in any appropriate way; for example, by being formed integrally with the base, permanently attached to the base or removably attachable to the base. The base is configured for engagement by the mounting means. The mounting means comprises an elastic band adapted to be hooked onto curved end portions of the base.

20 Claims, 11 Drawing Sheets

ORNAMENTATION FOR A FOOTWEAR UPPER

CONTINUING DATA

The present application is a continuation of International Patent Application No. PCT/AU2009/001265 filed Sep. 24, 2009 which designates the United States and claims priority to Australian Patent Application No. 2008904977 filed Sep. 24, 2008.

BACKGROUND OF THE INVENTION

1. Field of the Invention

The present invention relates to an ornamentation attachable to a strap. The invention has been devised particularly, although not solely, for attachment to a strap forming part of an item of footwear. The invention can however also be used for other clothing or accessory items and is especially suited to those having straps such as sandals, bags, or other clothing items.

2. Description of Related Art

The discussion of the background art throughout the specification is intended to facilitate an understanding of the present invention only. It should be appreciated that the discussion is not an acknowledgment or admission that any of the material referred to was published, known or part of the common general knowledge in Australia as at the priority date of the application.

Conventional footwear generally comprises a sole that is positioned beneath the foot of the wearer and an upper that at least partially encloses the foot of the wearer and provides a means of retaining the footwear on the foot of the wearer. Typically, if decorations are to be provided to such footwear, they are applied in the factory at the time of manufacture. In this case, decorations are generally fixedly attached to the footwear, either integrally or via certain attachment means.

As a result, in conventional footwear with decorations attached thereto, in general, the decorations cannot be detached from the footwear without permanently damaging the footwear or leaving undesirable marks on the footwear.

This is one of the drawbacks associated with conventional footwear as the appearance thereof cannot and/or is not intended to be changed. Therefore, when the wearer wishes to change the appearance of the footwear or feels that it is no longer fashionable, the wearer typically only has the option of purchasing a new footwear with a desirable appearance. The now older footwear will then typically be disposed or stored away although it is still in good wearable condition.

Furthermore, a wearer may wish to have the facility to add ornamentation to footwear. There is, therefore, a need for to provide a footwear which can be modified in appearance at ease according to a wearer's desire.

SUMMARY OF THE INVENTION

It is an object of the present invention to provide a footwear which, to at least some extent, overcomes the problems associated with conventional footwear as discussed in the background.

According to a first aspect of the present invention, there is provided an ornamentation attachable to a strap, the ornamentation comprising: a base; an ornament associated with the base and; a mounting means for mounting the base to the strap.

The ornament may be associated with the base in any appropriate way; for example, by being formed integrally with the base, permanently attached to the base or removably attachable to the base.

Preferably, the base is configured for engagement by the mounting means. The base may comprise end portions configured for engagement by the mounting means. With this arrangement, the mounting means may be hooked onto the base.

The base may comprise a body portion having an upper surface, a lower surface, a first end edge and a second end edge opposing the first end edge; and a curved extension extending from each of the first and second end edges of the body portion.

Preferably, the curved extensions initially curve upwardly from respective end edges of the body portion and then arc back toward the upper surface of the body portion.

Preferably, the first end edge of the body portion is longer than the second end edge of the body portion.

Preferably, a cross-section of the body portion is in the shape of a trapezium.

Preferably, a cross-section of the body portion is in the shape of an isosceles trapezium.

Preferably, the mounting means secures the base to the strap by being looped over one of the curved extensions, under the strap and then over the other of the curved extensions.

Preferably, the ornamentation further comprises a stem having a first end and a second end opposing the first end; wherein the first end is connected to the base and the second end is connected to the ornament such that the stem extends between the base and the ornament, connecting the ornament to the base.

Preferably, the stern, the base and the ornament are integrally connected forming an integral unit.

Preferably, the ornament comprises a design and a platform.

Preferably, the design is formed permanently on or detachably attached to a surface of the platform.

Preferably, the base comprises an attachment formation extending from the base for attachment of the ornament thereto.

Preferably, the ornament comprises a design and an attachment means extending from the design.

Preferably, the attachment means is shaped complementary to the attachment formation for either permanent or detachable attachment of the ornament to the base.

Preferably, the attachment means and attachment formation are configured as a hollow tube and a pin for insertion into the tube, corresponding magnets, corresponding button halves, or a slide channel for receiving a corresponding shaped formation.

Preferably, the mounting means is an elastic band.

Preferably, the strap is of a thong footwear.

Preferably, the body portion is a substantially planar portion.

In accordance with a second aspect of the present invention, there is provided an ornamentation mountable to a footwear upper, the ornamentation comprising a base and a platform spaced from each other and connected to each other via a stem extending therebetween.

In accordance with a third aspect of the present invention, there is provided an ornamentation attachable to a strap, the ornamentation comprising a base and a platform, the base comprises a well for receiving the strap therein, wherein side edges of the base comprises engagement formations for engaging corresponding attachment formations formed at edges of the platform.

In accordance with a fourth aspect of the present invention, there is provided an ornamentation attachable to a strap, the ornamentation comprising a base and a platform, the base comprising a well for receiving the strap therein, wherein a first side edge of the base is attached to a first side edge of the platform via a hinge connection, and a second side edge of the base comprises an engagement formation for engaging a corresponding attachment formation formed at a second side edge of the platform.

In accordance with a fifth aspect of the present invention, there is provided an ornamentation attachable to a footwear upper, the ornamentation comprising a base, an ornament removably attachable or permanently attached to the base and a mounting means for mounting the base to the footwear upper.

In accordance with a sixth aspect of the present invention, there is provided an ornamentation attachable to a strap, the ornamentation comprising a base and a mounting means for mounting the base to the strap, wherein the base is adapted to receive an ornament.

In accordance with a seventh aspect of the present invention, there is provided an ornamentation attachable to a strap, the ornamentation comprising a base and a mounting means for mounting the base to the strap, wherein the base is configured as an ornament.

In accordance with a seventh aspect of the present invention, there is provided an ornamentation attachable to a strap, the ornamentation comprising a base and a mounting means for mounting the base to the strap, wherein the base has an ornament attached thereto.

In accordance with an eight aspect of the present invention, there is provided an ornamentation attachable to a strap, the ornamentation comprising a base, a mounting means for mounting the base to the strap, and an ornament attached to the base.

In accordance with a ninth aspect of the present invention, there is provided an ornament adapted for attachment to the base of an ornamentation according any one of the preceding aspects of the present invention.

In accordance with a tenth aspect of the present invention, there is provided a footwear comprising a sole and a footwear upper, wherein the footwear comprises a strap having attached thereto the ornamentation according to any one of the above aspects of the present invention.

In accordance with an eleventh aspect of the present invention, there is provided a footwear comprising a sole and a footwear upper, the footwear upper comprises at least one strap attached to the sole, wherein at least one of the at least one strap comprises at least one attachment formation adapted to receive an ornament.

Preferably, the at least one attachment formation is one of an aperture, a first magnet and a first button half.

In accordance with a twelfth aspect of the present invention, there is provided an ornament attachable to a strap, the ornament comprising an attachment means, wherein the attachment means comprises one of a stem having one or more outwardly extending flanges, a second magnet and a second button half.

Preferably, the attachment means is attached to the corresponding attachment formation of the footwear according to the tenth aspect of the present invention.

In accordance with a thirteenth aspect of the present invention, there is provided an ornament attachable to a base of an ornamentation according to the preceding aspects of the present invention, the ornament comprises an attachment means adapted to receive or be received by a corresponding attachment formation of the base of the ornamentation.

BRIEF DESCRIPTION OF THE DRAWINGS

Embodiments of the present invention will now be described, by way of examples only, with reference to the accompanying drawings, in which.

DETAILED DESCRIPTION OF THE PREFERRED EMBODIMENTS

Figure 1:
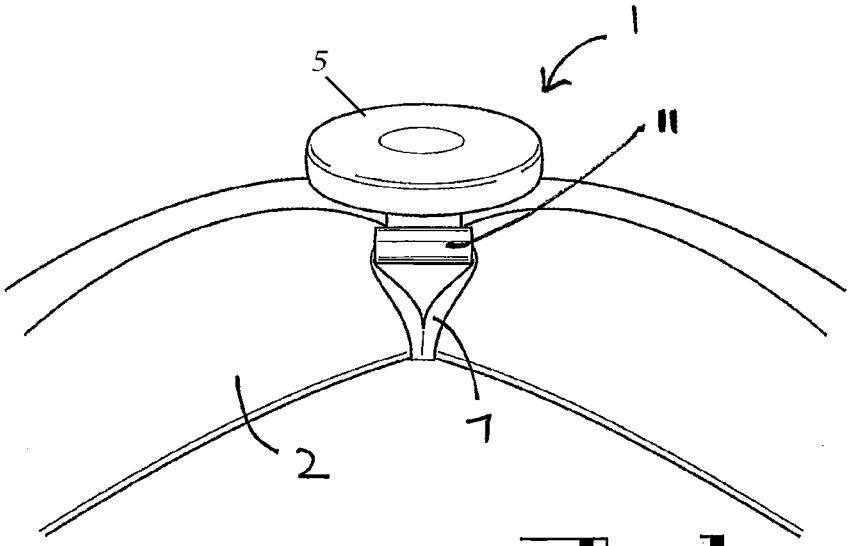
FIG. 1 is a schematic back perspective view of a thong footwear having an ornamentation according to a first embodiment of the present invention attached to the straps thereof.
Figure 2:
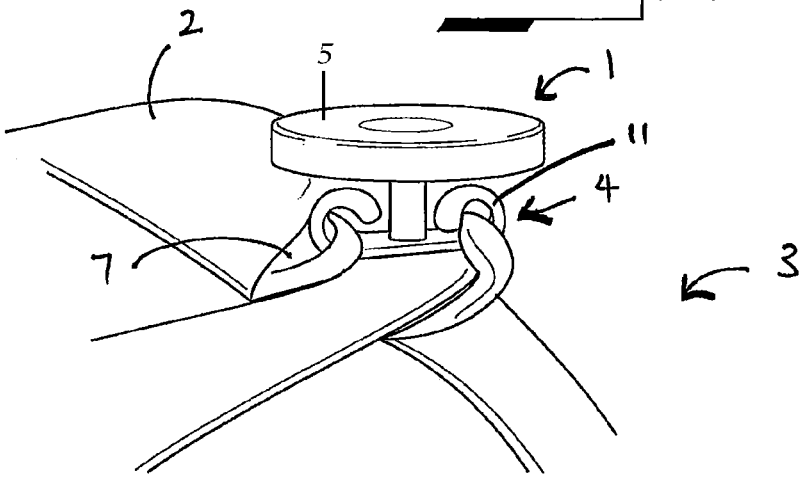
FIG. 2 is a schematic side perspective view of the thong footwear having the ornamentation according to the first embodiment of the present invention attached to the straps thereof.
Figure 3:
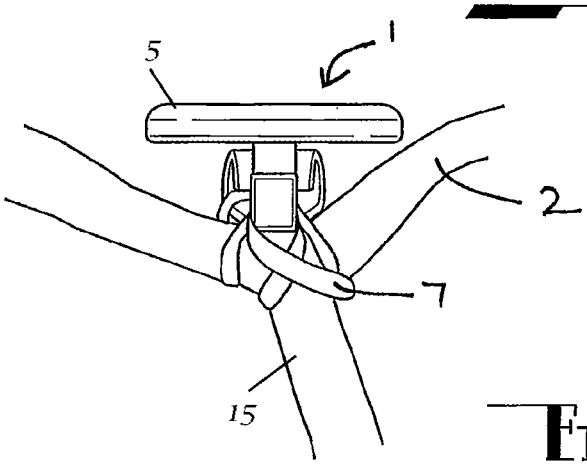
FIG. 3 is a schematic front perspective view of the thong footwear having the ornamentation according to the first embodiment of the present invention attached to the straps thereof.

FIGS. 1-3 respectively show the back, side and front perspective view of an ornamentation 1 according to a first embodiment of the present invention attached to a strap 2 of a thong footwear 3.

FIGS. 4*a*-4*k* show various schematic perspective views of the ornamentation 1 according to the first embodiment. The ornamentation 1 comprises a base 4, an ornament 5 and a stem 6 for connecting the ornament 5 to the base 4. In the first embodiment, the base 4 and the ornament 5 are integrally connected to the stem 6, that is, the ornament 5, the stem 6, and the base 4 form an integral unit. The ornamentation 1 further comprises a mounting means 7, as for example illustrated in FIGS. 1 and 2, for mounting the base 4 to a strap 2 of the thong footwear 3. For example, the strap can be made of a rubber or plastic material.

The base 4 comprises a body portion 8 having ends configured for engagement by the mounting means 7. The ends of the body portion 8 are configured such that the mounting means 7 can be hooked thereon. In the arrangement shown, the body portion 8 comprises a substantially planar portion, having an upper surface 9 and a lower surface 10. Further, in the arrangement shown, the ends of the planar portion 8 are configured as two curved extensions 11 extending from opposing end edges of the planar portion 8. The curved extensions 11 generally extend initially upwardly from the edges and then arc back toward the base upper surface 9 thus substantially forming hooks. The distal end of the extensions 11 can be bent slightly away from the upper surface 9 to form an entry portion of the hooks.

Figure 4A:
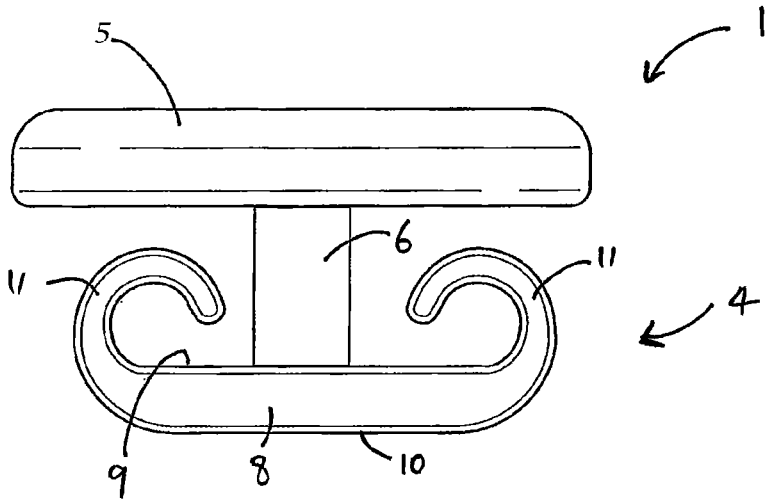
FIGS. 4*a*-4*k* are various schematic perspective views of the ornamentation according to the first embodiment of the present invention.
Figure 4B:
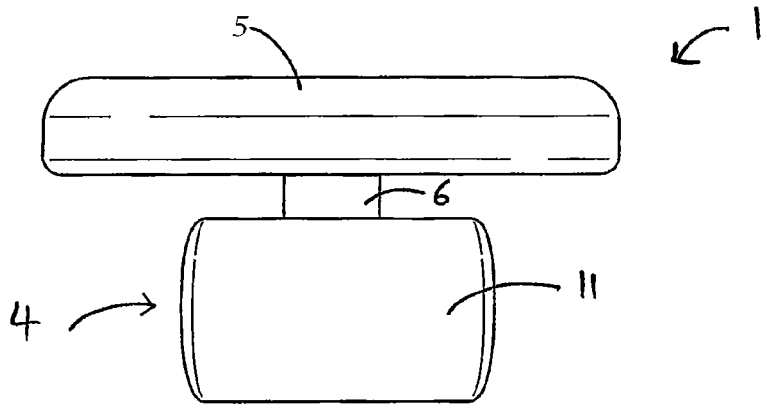
Figure 4C:
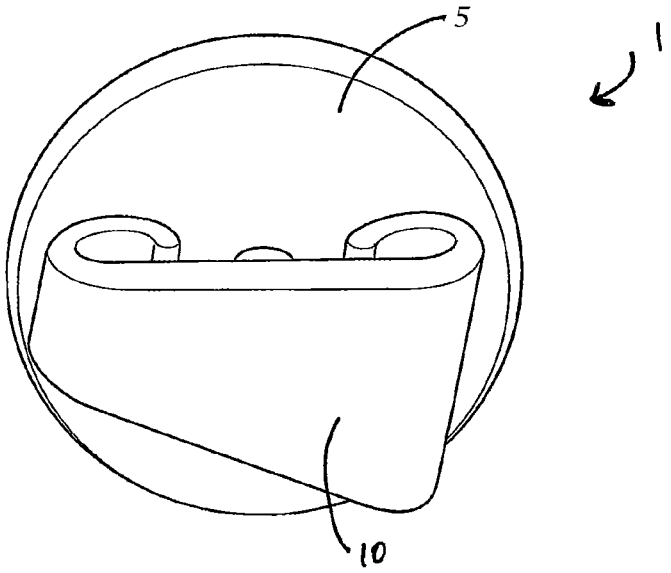
Figure 4D:
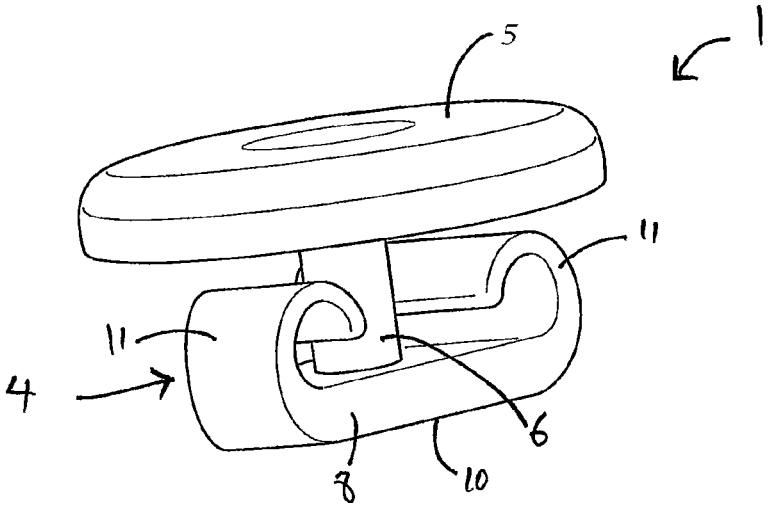
Figure 4E:
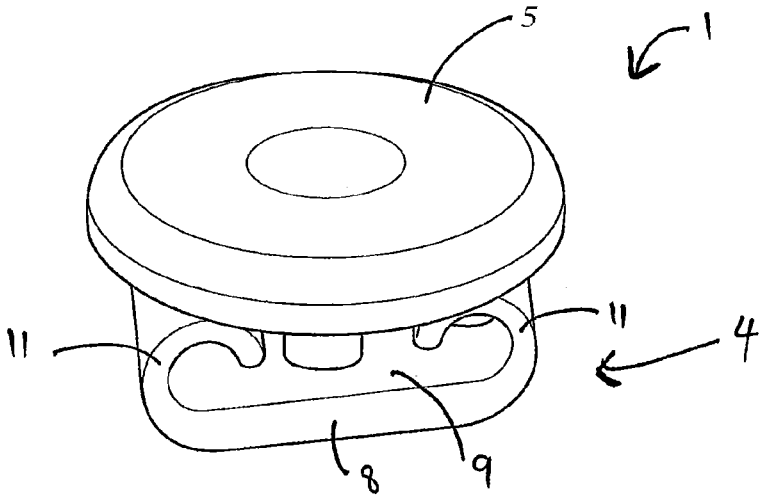
Figure 4F:
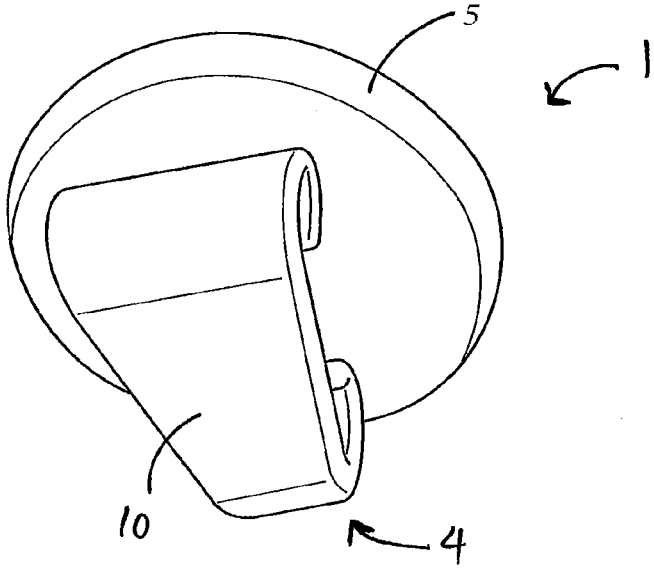
Figure 4G:
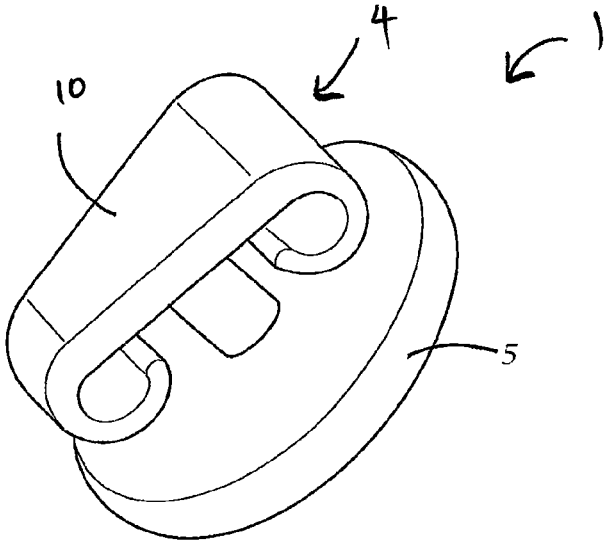
Figure 4H:
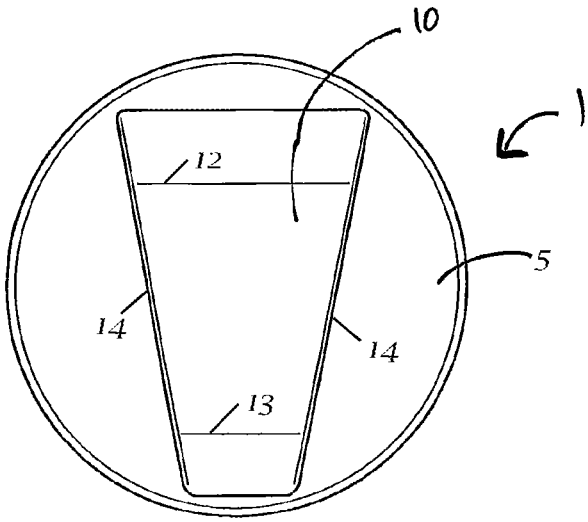
Figure 4I:
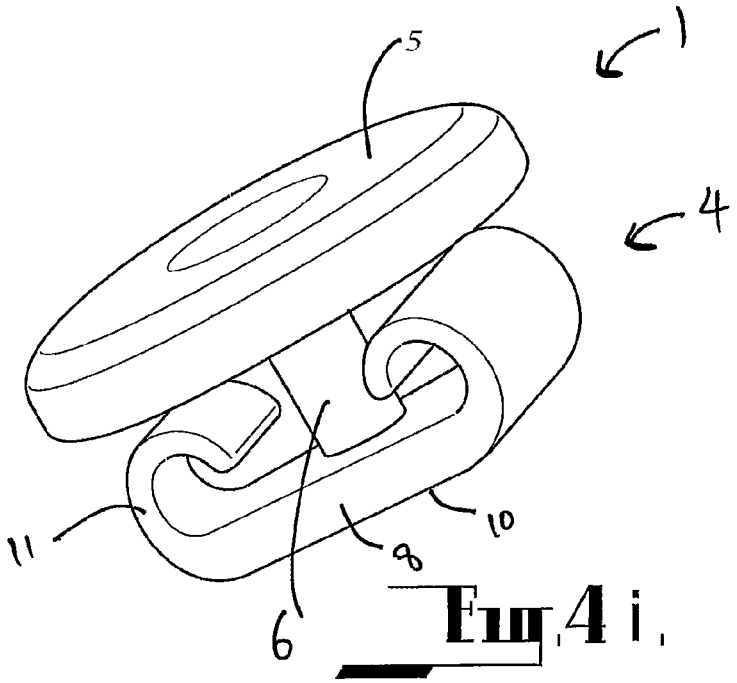
Figure 4J:
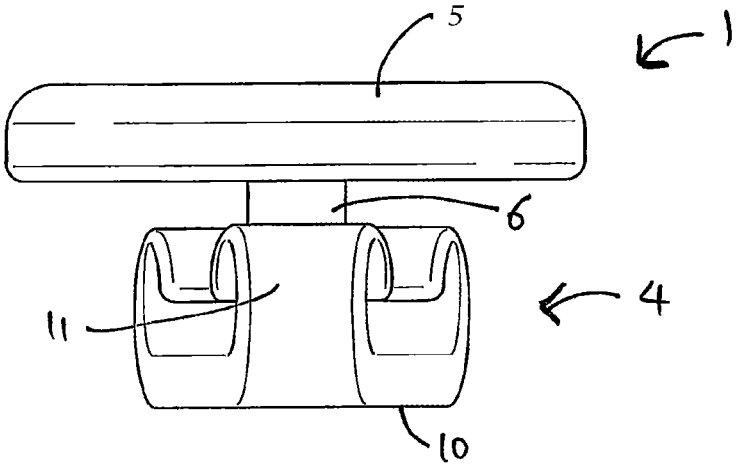
Figure 4K:
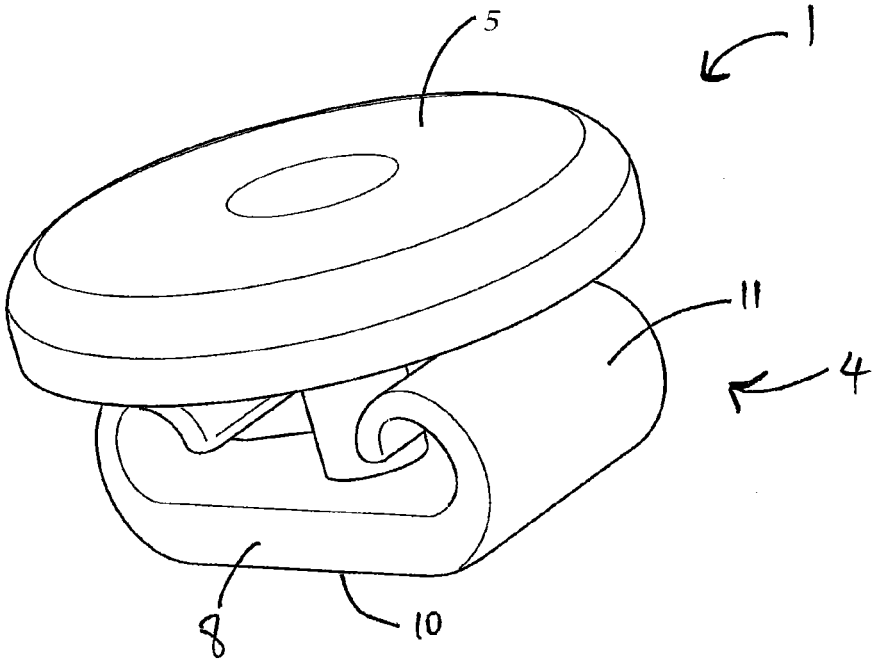

FIGS. 4*c*, 4*f*, 4*g* and 4*h* illustrate bottom perspective views of the ornamentation 1 according to the first embodiment. For example, as illustrated in FIG. 4*h*, the planar portion 8 of the base 4 comprises two opposing end edges 12, 13 and two opposing side edges 14. In the present embodiment, one of the opposing end edges 12, 13 of the planar portion 8 is longer than the other one of the opposing end edges 12, 13. Accordingly, the planer portion 8 tapers in a direction from the longer end edge 12 to the shorter end edge 13. As a result, the two opposing side edges 14 of the planar portion 8 converges from the longer end edge 12 to the shorter end edge 13.

Preferably, a planar cross-section of the planar portion 8 is in the shape of a trapezium. For example, the planar cross-section of the planar portion 8 can be in the shape of an isosceles trapezium. Due to the trapezium cross-sectional shape of the planar portion 8, the ornamentation 1 can be suitably mounted onto any position along the strap 2, even at difficult position such as a junction of the straps 2 with the toe mount 15 as for example shown in FIGS. 1 to 3. As shown, the ornamentation 1 is positioned at the junction such that the shorter end edge 13 of the planar portion 8 faces toward a front end of the thong footwear 3 and the longer end edge 12 of the planer portion 8 faces toward a rear end of the thong footwear 3.

In the first embodiment, as for example illustrated in FIG. 4*a*, the stem 6 comprises two opposing ends which are integrally connected to the upper surface 9 of the base 4 and the ornament 5 respectively. The bottom end of the stem 6 is integrally connected to the upper surface 9 of the base 4 at substantially the centre thereof along the length between the opposing end edges 12, 13. The top end of the stem 6 is integrally connected to the ornament 5 at substantially the centre portion of a bottom surface thereof. However, a person skilled in the art can understand that the stem 6 can be integrally connected to portions other than the centre of the planar portion 8 of the base 4 and the centre of a bottom surface of the ornament 5 depending on, for example, the characteristics and the desired visual appearance of the ornamentation 1.

In the first embodiment, the stem 6 has a circular cross-section which extends between the base 4 and the ornament 5. However, the cross-section of the stem 6 can be rectangular or other shapes as apparent to a person skilled in the art.

The ornament can comprise a design and a platform whereby the design is formed permanently on a surface of the platform, such as a top surface thereof. For example, a design may protrude from the top surface of the platform or embedded in the top surface of the platform. Alternatively, a design can be detachably attached to a surface of the platform.

FIGS. 1-3 schematically illustrate the manner in which the base 4 is mounted on the strap 2 of the thong footwear 3. A mounting means 7, which in the arrangement illustrated is an elastic band 7, is looped over one of the curved extensions 11 of the base 4, then under the strap 2, and subsequently looped over the other curved extension 11 of the base 4. This secures the base 4 to the strap 2 with the ornament 5 erected in an upright position.

If the base 22 is mounted at the junction of the straps 2 with the toe mount 15 as for example illustrated in FIG. 3, two elastic bands 7 are used to extend on either side of the toe mount such that the base 4 is located at substantially central of the junction.

Figure 5:
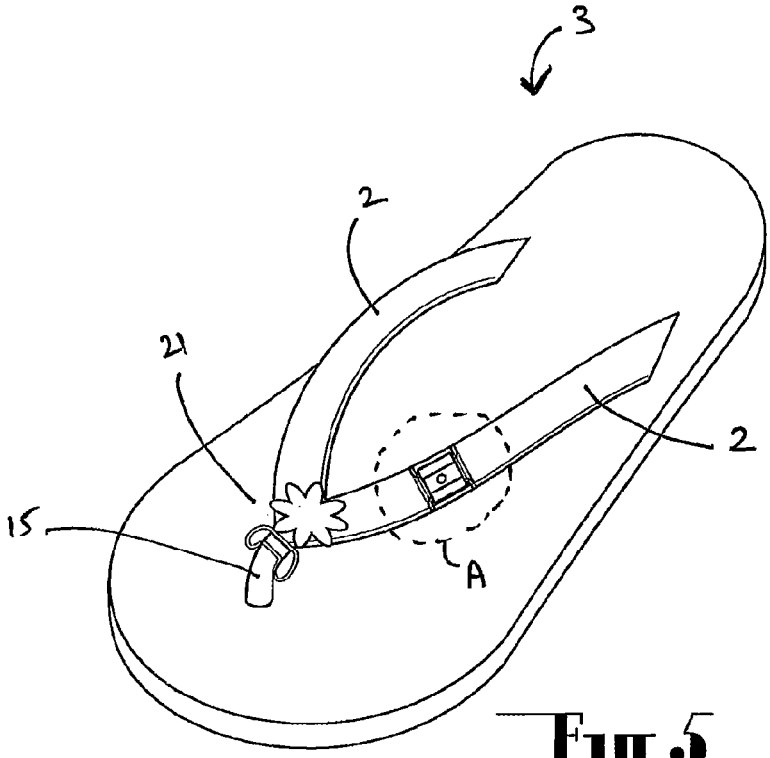
FIG. 5 is a schematic perspective view of a thong footwear having an ornamentation according to a second embodiment of the present invention attached to the strap(s) thereof.
Figure 6:
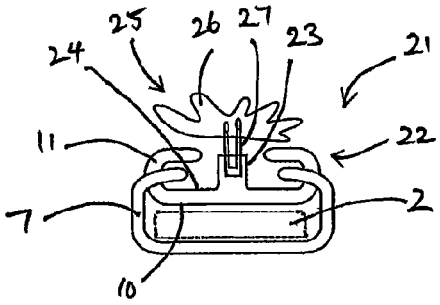
FIG. 6 is a schematic perspective view of a thong footwear having an ornamentation according to the second embodiment of the present invention attached to a strap.
Figure 7:
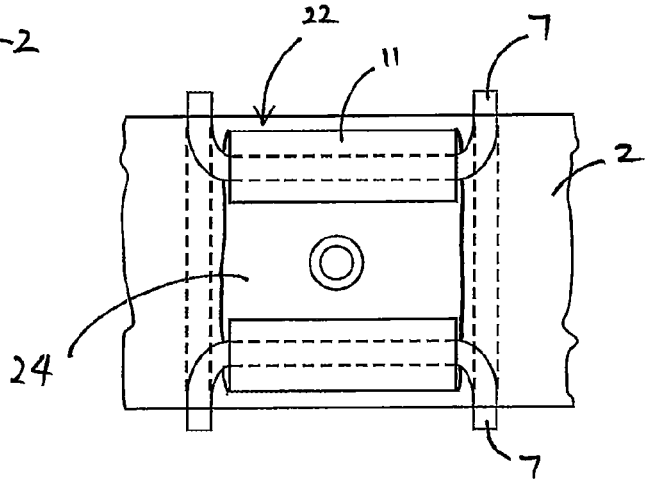
FIG. 7 is an enlarged view of section A in FIG. 5 schematically showing a top view of how the base of the ornamentation according to the second embodiment of the present invention is attached to the strap.

In the second embodiment, there is provided an ornamentation 21 similar to that described in the first embodiment. FIGS. 5-7 illustrate the ornamentation 21 attached to a strap 2 of a thong footwear 3 according to the second embodiment of the present invention. The base 22 is substantially the same as the base 4 described in the first embodiment of the present invention except that an attachment formation 23 extends from a centre of an upper surface 24 of the base 22 instead of the stem 6. The attachment formation 23 is provided for attachment of an ornament 25 thereto.

According to the second embodiment, each ornament 25 comprises a design 26 and an attachment means 27 extending from a lower surface of the design 26. For example, the attachment means 27 extends from a substantially central portion of the lower surface of the design 26. The ornament attachment means 27 is shaped complementary to the base attachment formation 23, either for permanent or detachable attachment of the ornament 25 to the base 22. If the ornament 25 is detachable from the base 22, ornaments with different designs 26 can be alternatively attached to the base 22 as desired.

Figure 8A:
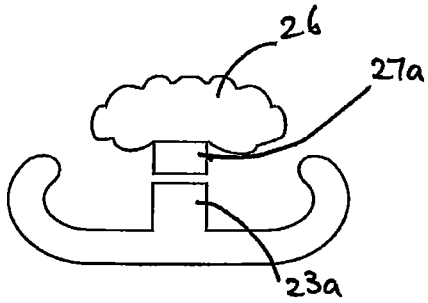
FIGS. 8*a*-8*c* are schematic side perspective views showing different detachable attachment arrangements between the ornament and the base of each ornamentation according to embodiments of the present invention.
Figure 8B:
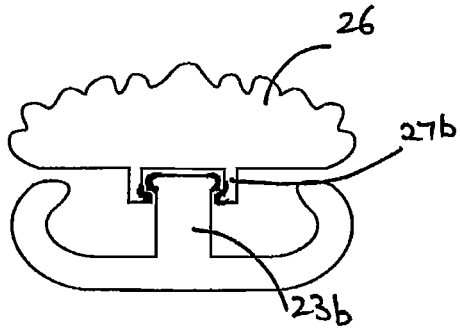
Figure 8C:
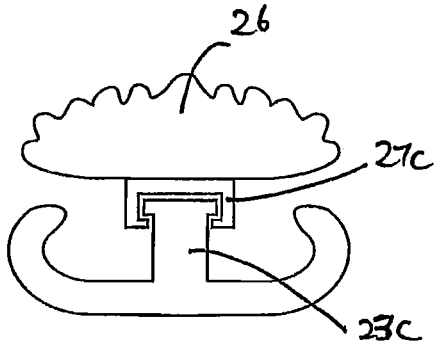

As shown in FIG. 6, the complementary attachment formation 23 and attachment means 27 can respectively be a hollow tube 23 and a pin 27 for insertion into the hollow tube 23. Other alternative embodiments according to the present invention are shown in FIGS. 8*a*-8*c*, which include magnets 23*a* and 27*a* shown in FIG. 8*a*, button halves 23*b* and 27*b* shown in FIG. 8*b*, or a slide channel 27*c* for receiving a corresponding shaped formation 23*c* as shown in FIG. 8*c*. Other suitable corresponding attachment means can also be used.

FIG. 7 schematically shows how the base 22 is mounted on top of the thong footwear strap 2. The manner in which the base 22 is mounted to the strap 2 is substantially the same as that described in the first embodiment, and thus will not be described again for conciseness.

Figure 9:
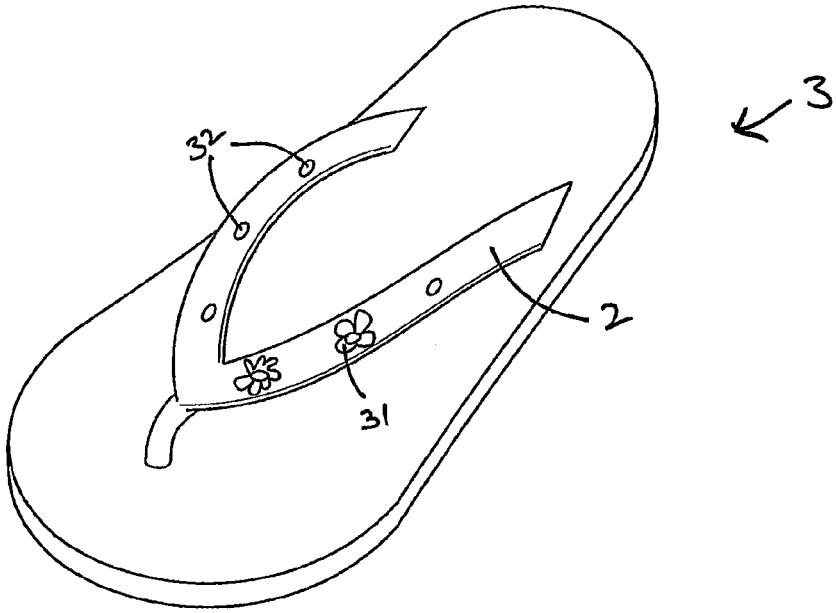
FIG. 9 is a schematic perspective view of a thong footwear having ornamentations according to a third embodiment of the present invention attached to a strap.

FIG. 9 illustrates an ornamentation 31 attached to a strap 2 of a thong footwear 3 according to a third embodiment of the present invention. In this embodiment, the base 4, 22 and mounting means 7 as described in the first and second embodiments are omitted. According to the third embodiment, the attachment formation 32 is formed in straps 2 for attachment of the ornamentations 31.

Figure 10:
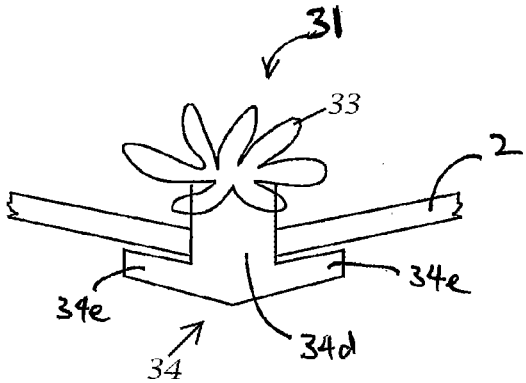
FIG. 10 is a schematic side view of the ornamentation according to the third embodiment of the present invention attached to a strap.

As shown in FIG. 10, the attachment formation 32 can be apertures formed in the straps 2 and the attachment means 34 of ornamentation 31 can comprise a stem 34*d* having outwardly extending flanges 34*e* for permanently mounting the ornament 33 to the strap 2. Other suitable permanent or detachable attachment of the ornament 33 to the strap 2 can also be used, such as magnets, button halves, or channels similar to that shown in FIG. 9.

It can be seen from the above that the present invention provides an effective and easy way of decorating a thong footwear which is versatile as the ornamentation 1, 21, 31 can be varied as required, without causing any permanent damage to the footwear. The ornamentation 1, 21, 31, 41, 51, 61 can be easily attached and removed as desired. The elastic band 7 used to attach the base 4, 22 to the strap 2 can be made of the same material as the strap 2 so there will be no irritation caused to the wearer. In addition, the ornamentation 1, 21, 31, 41, 51, 61 can be attached to other items as desired, such as clothing straps and bags as apparent to skilled persons in the art.

The base 4, 22 and ornament 5, 25, 33 can be formed from any suitable material, such as metal, plastics or rubber material.

Although preferred embodiments to the present invention have been described hereinabove, it will be apparent to skilled persons that the invention can be embodied in other forms or that modifications can be made to the above embodiments. For example, the mounting of the base 4, 22 to the strap 2 can be modified, so as to use twist wires or pins instead of an elastic band 7. The attachment of the ornament 5, 25, 33 to the base 4, 22 can also be varied. The lower surface 10 of the base 4, 22 can also be shaped to correspond to the strap 2 for a better fit. Alternatively, the lower surface 10 can be modified to include the mounting means 7 thereto, such as by having hook formations for engaging the strap 2.

Figure 11:
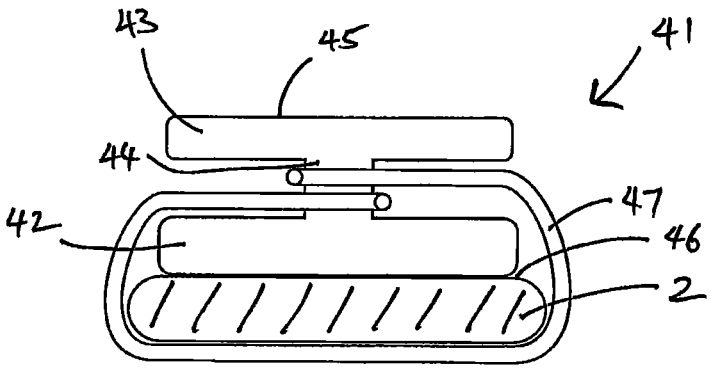
FIG. 11 is a schematic cross-sectional view of an ornamentation according to a fourth embodiment of the present invention attached to a strap of the thong footwear.

FIG. 11 shows an ornamentation 41 according to a fourth embodiment of the present invention attached to a strap 2 of the thong footwear 3. The ornamentation 41 comprises a planar base 42 and a planar platform 43 which are spaced from and substantially parallel to each other. The base 42 and platform 43 are connected to each other by a stem 44 extending therebetween. A design can be formed in an upper surface 45 of the platform 43 or attachable thereto by any suitable means. In use, the base 42 is positioned at a desired location on the top surface 46 of the strap 2. An elastic band 47 can then be used to mount the ornamentation 41 to the strap 2, with the elastic band 47 looped around one side of the stem 44, under the strap 2 and then looped around the other side of the stem 44.

Figure 12:
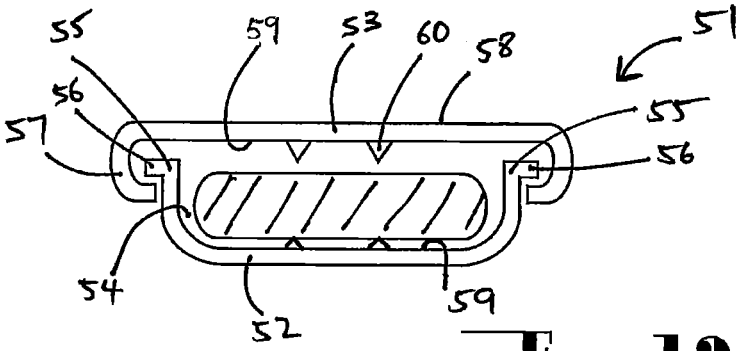
FIG. 12 is a schematic cross-sectional view of an ornamentation according to a fifth embodiment of the present invention attached to a strap of the thong footwear.

FIG. 12 shows an ornamentation 51 according to a fifth embodiment of the present invention attached to the strap 2. The ornamentation 51 comprises a base 52 and a platform 53. The base 52 is shaped to be positioned under the strap 2 and includes a well 54 for receiving the strap 2 therein. The side edges 55 of the base 52 include engagement tabs 56 corresponding to and for engaging corresponding attachment formations 57 formed at edges of the platform 53. In use, the base 52 is positioned from under the strap 2 such that the strap 2 is received in the well 54. The platform 53 can then be positioned above the strap 2 and attached to the base 52 to retain the ornamentation 51 onto the strap 2. A design can be formed in the upper surface 58 of the platform 53 or attachable thereto by any suitable means. Preferably, inner surfaces 59 of the base 52 and platform 53 include engagement spikes 60 or the like for engaging the strap 2 to retain the ornamentation 51 in position therealong when attached.

Figure 13:
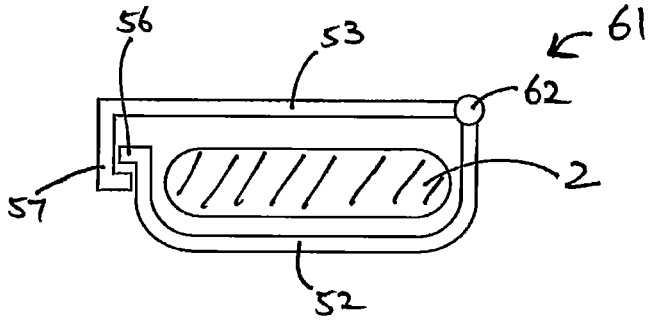
FIG. 13 is a schematic cross-sectional view of an ornamentation according to a sixth embodiment of the present invention, the ornamentation is a modification of the ornamentation according to the fifth embodiment of the present invention.

FIG. 13 shows an ornamentation 61 according to a sixth embodiment of the present invention, which is a modification of the ornamentation 51 according to the fifth embodiment as shown in FIG. 8. In the sixth embodiment, one side edge of the base 52 and platform 53 are attached to each other via a hinge 62, with the other side edges having the engagement tab 56 and attachment formation 57.

According to another embodiment of the present invention, the ornamentations of the above-described embodiments are modified such that instead of an ornament permanently attached or detachably attached to the base, the base is designed or configured as an ornament. The base comprises two curved extensions extending from opposing end edges thereof. The curved extensions generally extend initially upwardly from the edges and then arc back toward an upper surface of the base, thus substantially forming hooks.

Modifications and variations such as would be apparent to a skilled addressee are deemed to be within the scope of the present invention.

Throughout the specification and claims, unless the context requires otherwise, the word "comprise" or variations such as "comprises" or "comprising" will be understood to imply the inclusion of a stated integer or group of integers but not the exclusion of any other integer or group of integers.

Further, throughout the specification, unless the context requires otherwise, the word "include" or variations such as "includes" or "including" will be understood to imply the inclusion of a stated integer or group of integers but not the exclusion of any other integer or group of integers.

What is claimed is:

1. A footwear comprising a sole and a footwear upper, wherein the footwear comprises a strap having an ornamentation attached thereto, and wherein the ornamentation comprises:

a base for supporting an ornament, the base comprising a body portion having substantially rigid curved opposing ends; and a mounting means looped over one of the opposing ends, under the strap and then over the other of the opposing ends.

2. The footwear according to claim 1, wherein the footwear is thong footwear.

3. The footwear according to claim 1, wherein the mounting means comprises a same material as the strap.

4. An ornamentation attachable to a strap, the ornamentation comprising:

a mounting means;

an ornament;

a stem having a first end connected to the ornament; and a base for supporting the ornament, the base comprising:

a body portion connected to a second end of the stern such that the stem extends between the body portion and the ornament; and substantially rigid curved extensions on opposing ends of the body portion which curve from its upper surface towards each other, wherein the substantially rigid curved extensions are configured for engagement with the mounting means to secure the base to the strap by looping the mounting means over one of the extensions, under the strap and then over the other of the extensions.

5. The ornamentation according to claim 4, wherein the mounting means comprises an elastic band.

6. The ornamentation according to claim 4, wherein one of the opposing ends of the body portion is wider than the other of the opposing ends.

7. The ornamentation according to claim 6, wherein the body portion is in the shape of a trapezium.

8. The ornamentation according to claim 4, wherein the stem, the base and the ornament are integrally connected forming an integral unit.

9. The ornamentation according to claim 4, wherein the ornament comprises a design and a platform.

10. The ornamentation according to claim 9, wherein the design is formed permanently on or detachably attached to a surface of the platform.

11. The ornamentation according to claim 4, wherein the stem comprises:

a first attachment formation extending from the body portion; and a second attachment formation extending from the ornament, wherein the first and second attachment formations are complementarily configured for either permanent or detachable attachment to each other.

12. The ornamentation according to claim 11, the first and second attachment formations are respectively configured as a hollow tube and a pin for insertion into the tube, corresponding magnets, corresponding button halves, or a slide and a slide channel.

13. The ornamentation according to claim 4, wherein the body portion comprises a substantially planar portion.

14. An ornamentation attachable to a strap, the ornamentation comprising:

an ornament;

a mounting means; and a base for supporting the ornament, the base comprising:

a body portion having two opposing lateral ends and an upper surface disposed therebetween, wherein the ornament is coupled to the upper surface; and extensions respectively extending from the opposing lateral ends of the body portion, wherein the extensions are configured for engagement with the mounting means to secure the base to the strap, and wherein one of the opposing lateral ends is wider than the other one of the opposing lateral ends.

15. The ornamentation according to claim 14, wherein the body portion is in the shape of a trapezium.

16. The ornamentation according to claim 14, further comprising a stem having opposing ends respectively coupled to the ornament and the upper surface of the body portion.

17. A footwear comprising a strap having an ornamentation attached thereto, and wherein the ornamentation comprises:

an ornament;

a base supporting the ornament, wherein the base comprises:

a body portion having two opposing lateral ends and an upper surface disposed therebetween, wherein the ornament is coupled to the upper surface; and extensions respectively extending from the opposing lateral ends of the body portion, wherein one of the extensions is wider than the other extension; and a mounting means engaged with opposing lateral ends of the base to secure the base to the strap.

18. The footwear according to claim 17, wherein the footwear is a thong footwear, and wherein the ornamentation is positioned at a junction of the strap and a thong of the footwear such that the extension faces toward a rear end of the thong footwear and the other extension faces a front end of the thong footwear.

19. The footwear according to claim 18, wherein the mounting means comprises two bands on either side of the thong.

20. The footwear according to claim 17, wherein the mounting means comprises a same material as the strap.

* * * * *

UNITED STATES PATENT AND TRADEMARK OFFICE

CERTIFICATE OF CORRECTION

PATENT NO. : 8,671,595 B2
APPLICATION NO. : 13/070887
DATED : March 18, 2014
INVENTOR(S) : Nelson It is certified that error appears in the above-identified patent and that said Letters Patent is hereby corrected as shown below:

IN THE CLAIMS:

Claim 18, col. 10, line 22: insert the word --wider-- after the phrase "such that the"

Signed and Sealed this
Thirtieth Day of September, 2014

Michelle K. Lee

Michelle K. Lee
*Deputy Director of the United States Patent and Trademark Office*